United States Patent [19]

Uhlig

[11] 4,209,100

[45] Jun. 24, 1980

[54] SAFETY CLOSURE

[75] Inventor: Albert R. Uhlig, Toledo, Ohio

[73] Assignee: Owens-Illinois, Inc., Toledo, Ohio

[21] Appl. No.: 44,871

[22] Filed: Jun. 1, 1979

[51] Int. Cl.[2] ..... B65D 55/02; B65D 85/56; A61J 1/00

[52] U.S. Cl. ..... 215/216; 215/237; 220/281; 222/153; 222/480

[58] Field of Search ..... 215/209, 216, 224, 237, 215/235; 222/153, 480, 543

[56] References Cited

U.S. PATENT DOCUMENTS

| | | | |
|---|---|---|---|
| 3,036,746 | 5/1962 | Hagen | 222/153 X |
| 3,323,671 | 6/1967 | Minarik, Jr. et al. | 215/237 |
| 3,604,585 | 9/1971 | Towns | 215/235 |
| 3,927,805 | 12/1975 | Stull | 222/153 |
| 4,022,352 | 5/1977 | Pehr | 222/153 |
| 4,042,105 | 8/1977 | Taylor | 220/281 X |

*Primary Examiner*—George T. Hall
*Attorney, Agent, or Firm*—John R. Nelson; Myron E. Click; David H. Wilson

[57] ABSTRACT

An improved safety closure for containers of harmful products includes an inverted cup-shaped body member formed of resilient plastic material and an integrally molded locking flap connected by an integral hinge to the top periphery of the body member. The locking flap folds into a conforming recess in the top surface of the body portion and, in its folded position, all edges of the locking flap are flush with the adjacent top surface of the body portion. Dispensing openings are provided in the top wall of the body portion and sealing means are provided on the bottom wall of the flap to close the dispensing openings in the folded position of the locking flap. Cooperating latching surfaces are provided on the flap and the body portion to retain the flap in its folded position. A portion of the annular wall of the body portion is recessed so as to permit manual inward depression of a segment of the outer wall of the body portion. Such depression effects a camming action on the locking flap to force at least an edge portion of the locking flap out of flush engagement with the body portion to permit the locking flap to be manually lifted to a fully open position.

12 Claims, 17 Drawing Figures

SAFETY CLOSURE

BACKGROUND OF THE INVENTION

This invention relates to safety closures for necked containers and more particularly to improved safety closures of the type having an integral flap that is normally flush mounted and locked in a depression in the top surface of the closure. Such locking flap carries means on its underside for sealingly engaging a dispensing opening provided in the top or base portion of the closure.

There has been a number of disclosures in the prior art of so-called child resistant or safety closures for neck containers which have incorporated a closure body portion and an integrally molded, hinged locking flap portion cooperating with the body portion to effect the closing of one or more dispensing openings in the body portion. Typical of such prior art disclosures are U.S. Pat. Nos. 3,845,872 to Townes, 3,927,805 to Stull and 4,022,352 to Pehr. The alleged safety feature embodied in each of these prior art safety closure constructions is the necessity for the application by the fingers of a significant downward force to a specific location on the top wall of the closure. It has been recognized, however, that this type of actuation may be inadvertently applied by a child through the simple expedient of banging the container with the closure attached against a hard surface in such manner that a downward opening force of the proper magnitude is applied to the proper spot on the safety closure. The possibility of such inadvertent opening of the closure by children significantly limits the usefulness of such prior art safety closure constructions.

SUMMARY OF THE INVENTION

In accordance with this invention, a safety closure is provided of the type having a molded plastic inverted cup-shaped body portion connected by an integral hinge to a foldable locking flap, the locking flap being foldable into an appropriate depression provided in the top of the body portion so that the edges of the locking flap are made flush with the adjacent surface and inaccessible for actuation of the flap by the fingernails. In its closed folded position, sealing means on the locking flap cooperate with one or more openings provided in the body portion of the closure to define dispensing outlets. Additionally, locking surfaces on the locking flap cooperate with appropriately formed surfaces on the body of the closure to retain the flap in its folded, recessed position.

The disengagement of the locking surfaces between the flap and the body portion of the closure is effected by providing one or more recesses in the annular wall of the body portion so as to permit a segment of the outer wall adjacent such recesses to be inwardly deformable through the application of manual pressure by the thumb and forefinger. The resulting inward movement of the inwardly depressable wall segment effects the elevation at least an edge portion of the locking flap sufficiently to permit the flap to be engaged first by the fingernail and then by the fingers and thus lifted to a fully open position wherein the flap sealing means are completely disengaged from the dispensing outlet formed in the closure body portion.

A closure of this type may be fabricated by injection molding and hence represents an item that can be economically produced at high speeds on large multicavity injection molding machines. More importantly, since the force required to actuate the closure to initiate the opening sequence is that produced by a compression action between the thumb and forefinger, it is very readily possible to design the closures so that such force is beyond the capability of any child but well within the capability of a typical adult, including senior citizens. More importantly, if this type of opening force is inadvertently applied to the container by banging the closure against a rigid object, the closure will not open. Not only must a squeezing force be applied to the sidewalls of the closure, but concurrently, a fingernail must be utilized to grasp the slightly elevated edge of the locking flap at the same time to lift the flap from its folded position and thus effect the complete opening of the safety closure. If the lateral pressure is released before the edge of the flap is lifted, the flap will return to its normal locked position. Thus the possibility of the closure being inadvertently opened by rough handling in the hands or mouth of a child is practically zero.

Other advantages of this invention will become apparent to those skilled in the art from the following detailed description, taken in conjunction with the annexed sheets of drawings on which are shown several modifications of this invention.

DESCRIPTION OF PREFERRED EMBODIMENTS

Figure 1:
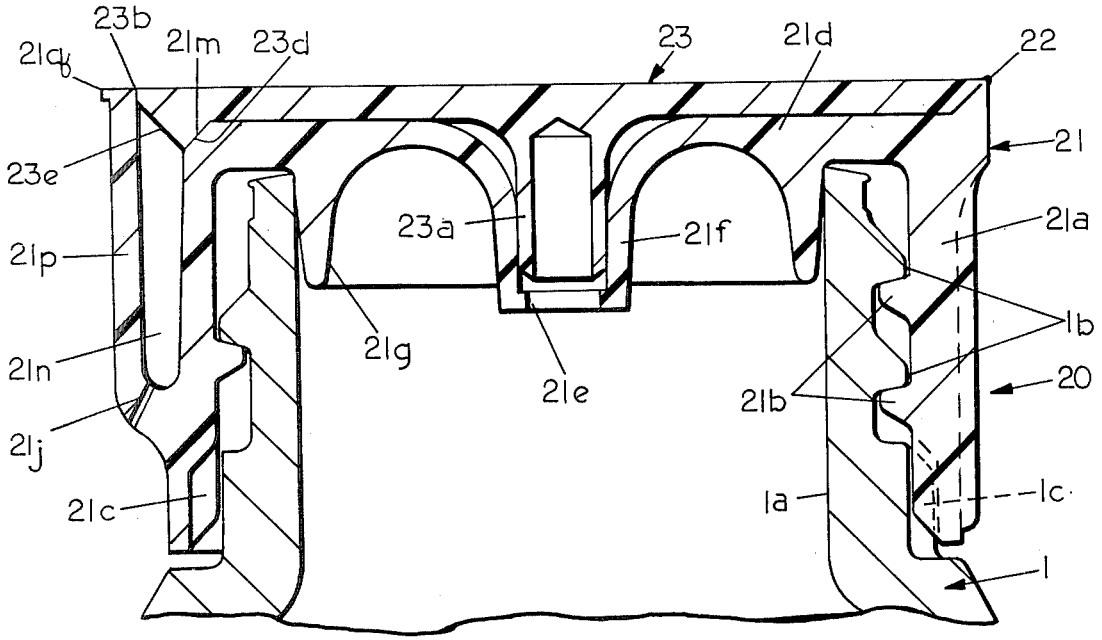
FIG. 1 is a vertical sectional view of a safety closure embodying this invention assembled to the neck of a container, with the locking flap of the closure being disposed in its locked position.
Figure 2:
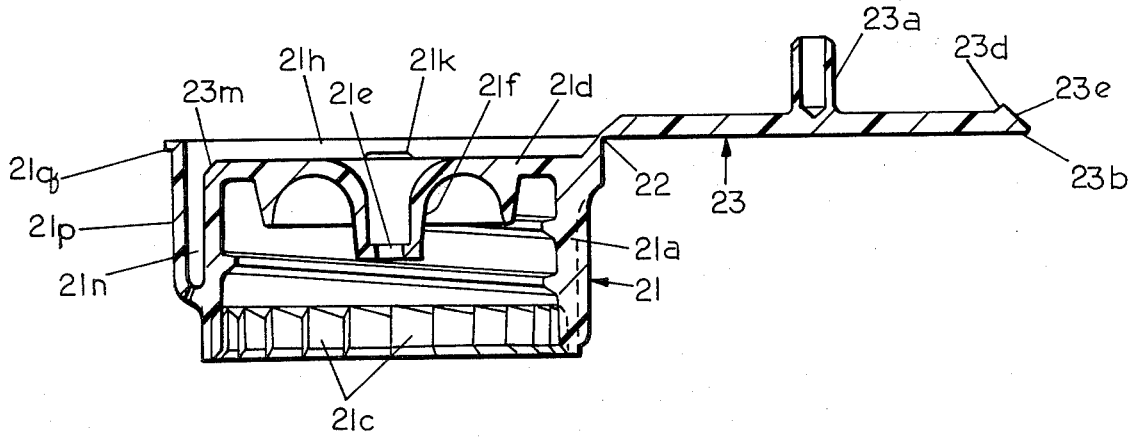
FIG. 2 is a vertical sectional view of the closure incorporated in FIG. 1 but with the locking flap disposed in its open, as molded, position.
Figure 3:
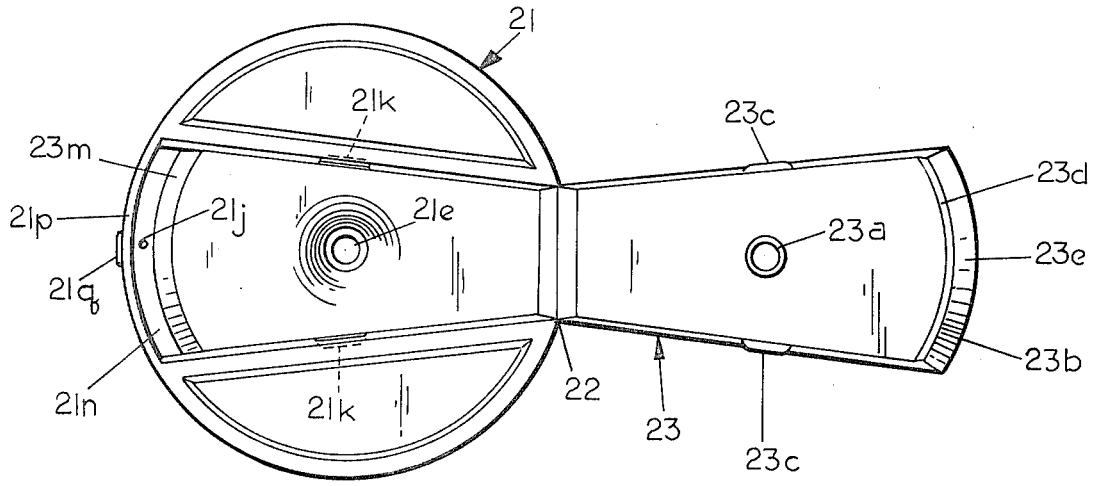
FIG. 3 is a top elevational view of FIG. 2.
Figure 4:
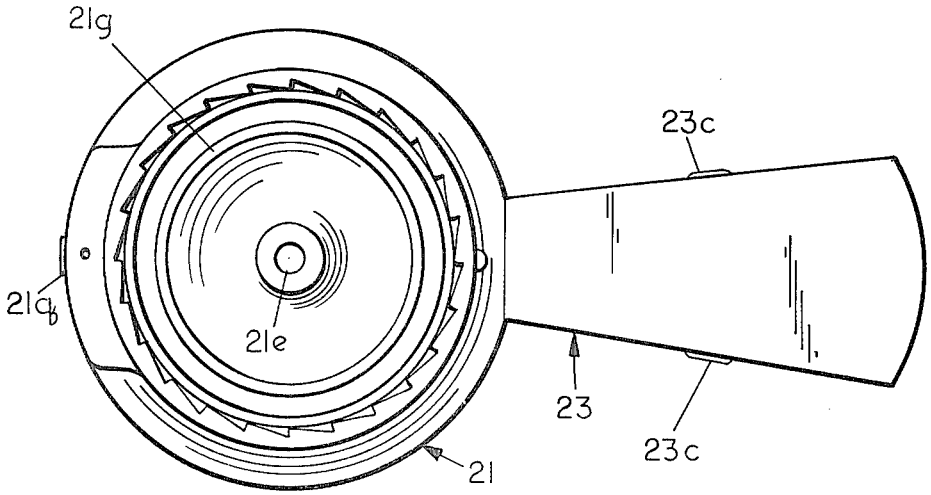
FIG. 4 is a bottom elevational view of FIG. 2.

Referring now to FIGS. 1 through 4 there is shown a safety closure embodying a modification of this invention. Closure 20 is shown in assembled relationship to the neck portion 1*a* of a container 1. Neck portion 1*a* is provided with closure securement threads 1*b* and a plurality of circumferentially spaced vertical splines 1*c* which effect the locking of the safety closure 20 to the container neck. Closure 20 comprises an inverted cup-shaped body portion 21 connected by an integral hinge 22 to a locking flap portion 23. Closure 20 is formed by injection molding of a resilient plastic material such as polyethylene or polypropolene. The body portion 21 is of an inverted cup-shape having an annular sidewall 21*a* on which are formed internal threads 21*b* and a plurality of circumferentially spaced ratchet teeth 21*c* which cooperate with the splines 1*c* formed on the container neck 1*a* to securely hold the closure in assembled relationship on the container neck 1*a*.

Additionally, the closure body portion 21 is provided with a base portion 21*d* extending across the top of annular sidewall 21*a*. Base portion 21*d* defines at least one dispensing opening, such as opening 21*e* which is defined by a depending tubular portion 21*f* which communicates with the contents of the container 1. The under surface of base portion 21*d* is provided with a depending annular flange 21*g* which is shaped to snugly conform to the top portions of the container neck 1*a* and to achieve a sealing relationship therewith when the body portion 21 is firmly screwed into engagement with the neck threads 1*b*. The cooperating splines 1*c* and ratchet teeth 21*c* insure that the body portion of the closure 20 cannot be removed from the container neck, once it has been assembled thereto, except through the application of an excessive force, far beyond the capabilities of any child.

The base portion 21*d* of the body portion 21 is shaped so as to provide a shallow depression 21*h* snugly conforming to the edge contour of the locking flap 23. Thus, when locking flap 23 is folded around its integral hinge 22, it will assume the position shown in FIG. 1 wherein all of the edges of the locking flap 23 are essentially flush with the top surface of the body portion 21, and hence not susceptible to being engaged by the fingernails or teeth of a child. An annular protuberance 23*a* is formed in the central portion of locking flap 23 and snugly engages the inner walls of the tubular element 21*f* to effect the sealing of the dispensing opening 21*e* when locking flap 23 is in its closed, locked position illustrated in FIG. 5. Such frictional engagement assists in holding locking flap 23 in its folded, locking position.

To effect the locking of flap 23 in its folded position, the locking flap 23 is proportioned so that its free end surface 23*b* snugly engages the top portion of a wall segment 21*p* formed in the annular sidewall 21*a* by a recess 21*n*. Additionally, a pair of lateral projections 23*c* may be provided on a medial portion of the locking flap 23. Projections 23*c* respectively engage undercut recesses 21*k* respectively provided in the sidewalls of the recess 21*h* which receives the locking flap 23. Additionally, an arcuate camming surface 23*d* on the underside of the free end of locking flap 23 is in snug engagement with a cam surface 21*m* provided on the base portion 21*d* of the body 21.

Figure 5:
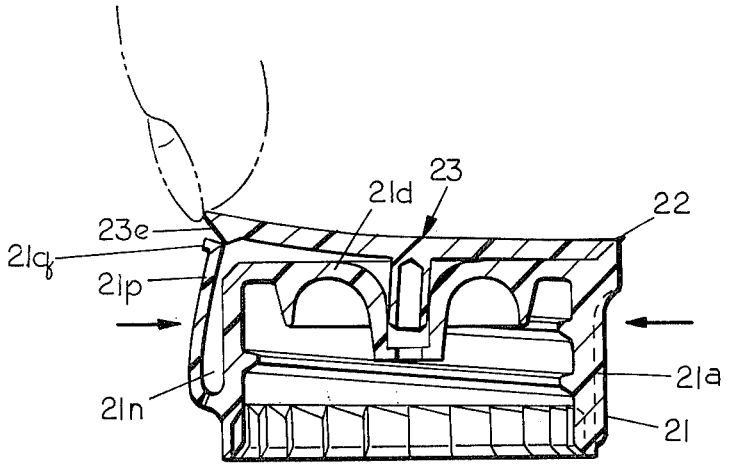
FIG. 5 is a view similar to FIG. 1 but showing the locking flap in its position preliminary to effecting the opening of the closure.

To effect the opening of the described safety closure, this invention provides one or more recesses 21*n* in the annular wall 21*a* of the body 21. One such recess 21*n* is preferably disposed below a portion of the locking flap 23 and, in this modification, underlies the free end of locking flap 23. A drainage opening 21*j* may be provided in the bottom of recess 21*n*. The exterior wall 21*p* of recess 21*n* is thereby freed for laterally inward movement under a squeezing force applied by the thumb and forefinger to the sidewalls of the body 21. The effect of such movement is illustrated in FIG. 5 and shows that the top end of the deformable wall segment 21*p* rides against an inclined surface 23*e* provided on the end of locking flap 23 forcing such surface upwardly so that the extreme free edge of locking flap 23 is removed from its position of flush engagement with the base portion 21*d* to a slightly upwardly projecting position, where it can be engaged either by the fingernail or by two fingers of the person opening the closure.

It is therefore apparent that a prescribed sequence of manipulations must be performed in order to effect the opening of the safety closure. The mere inadvertent bumping of the deformable wall segment 21*p* will result in a momentary upward displacement of the free edge of the locking flap 23 but, unless this is followed by slipping the fingernail under the exposed edge of the locking flap, the locking flap will return to its fully locked position as soon as the lateral pressure on the deformable wall segment 21*p* is released. Thus the possibility of inadvertent opening of the closure by a child banging it against a rigid object is completely minimized.

To prevent opening by chewing on the rim of the closure, this invention provides a laterally projecting tab 21*q* on the top portion of the deformable wall segment 21*p*.

Figure 6:
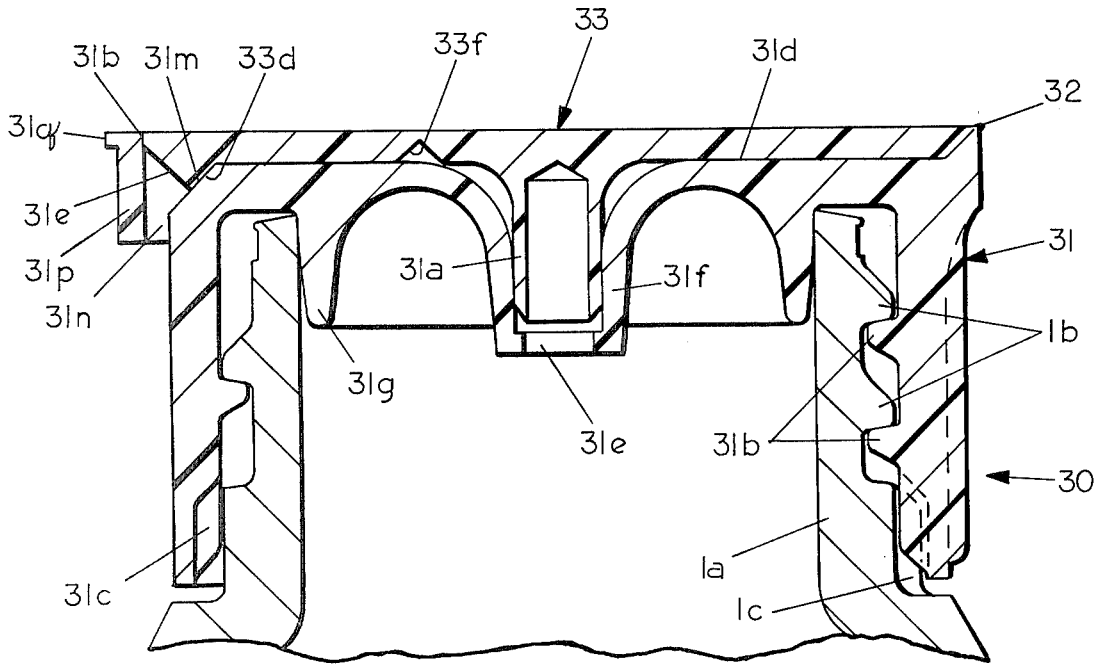
FIG. 6 is a vertical sectional view of a safety closure embodying a modification of this invention shown in assembled relationship on the neck of a container.
Figure 7:
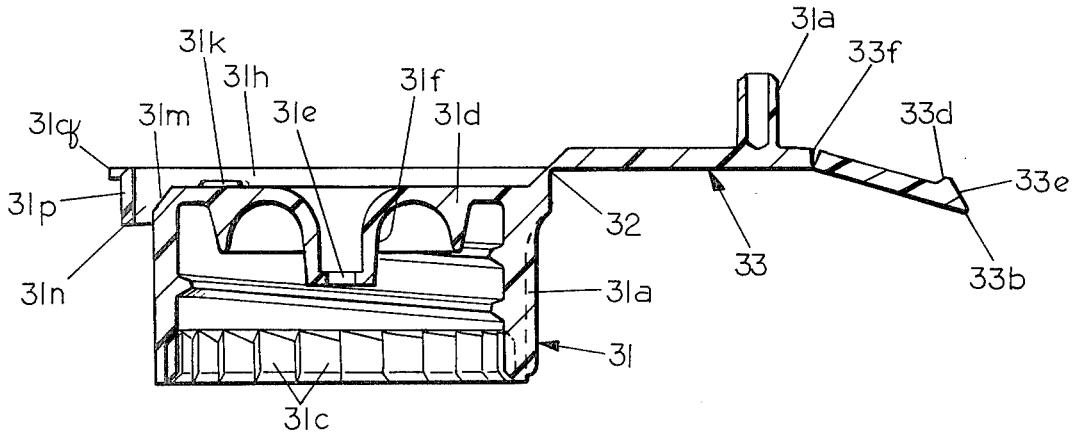
FIG. 7 is a vertical sectional view of the safety closure of FIG. 5, showing the locking flap in its open, as molded, position.
Figure 8:
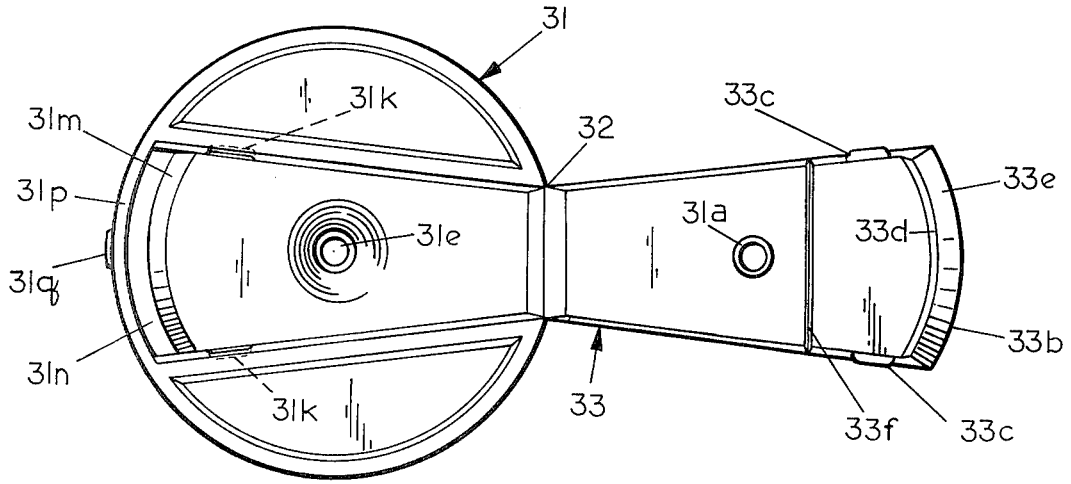
FIG. 8 is a top elevational view of FIG. 6.

Referring now to FIGS. 6 through 8 of the drawings, there is shown a modified form of closure 30. Closure 30 comprises an inverted cup-shaped body portion 31, a locking flap 33, and an integral hinge connection 32 between the locking flap 33 and the top peripheral corner of the body portion 31. Threads 31*b* are provided on the interior of the annular wall 31*a* of the body portion 31 to cooperate with the container threads 1*b*, and a plurality of circumferentially spaced ratchet teeth 31*c* are also provided on the annular body portion 31*a* which cooperate with the splines 1*c* formed on the container neck 1*a* to securely hold the closure 30 in assembled relationship on the container neck 1*a*.

Additionally, the closure body portion 31 is provided with a base portion 31*d* extending across the top of the annular portion 31*a*. Base portion 31*d* has an integral depending tubular portion 31*f* defining a dispensing opening 31*e* which communicates with the contents of the container 1. The under surface of base portion 31*d* is provided with a depending annular flange 31*g* which is shaped to snugly conform to the top portions of the container neck 1*a* and to achieve a sealing relationship therewith when the body portion 31 is firmly screwed into engagement with the neck threads 1*b*.

The base portion 31*d* of the body portion 31 is shaped so as to provide a shallow depression 31*h* snugly conforming to the edge contour of the locking flap 33. Thus when locking flap 33 is folded around its integral hinge 32, it will assume the position shown in FIG. 6 wherein all edges of the locking flap 33 are essentially flush with the top surface 31*d* of the body portion 31, and hence not susceptible to be engaged by the fingernails or teeth of the child. An annular protuberance 33*a* is formed in the central portion of the locking flap 33 and snugly engages the inner walls of the tubular element 31*f* to effect the sealing of the dispensing opening 31*e* when locking flap 33 is in its folded locked position illustrated in FIG. 6.

To effect the locking of flap 33 in its folded position, the locking flap 33 is proportioned so that its free end surface 33*b* snugly engages the top portion of a wall 31*p* formed as an integral lateral extension of the annular sidewall 31*a* and being separated from the major portion of such sidewall by a recess 31*n*. Additionally, a pair of lateral projections 33*c* may be provided on a outer portion of the locking flap 33. Projections 33*c* respectively engage undercut recesses 31*k* respectively provided in the sidewalls of the depression 31*h* which receives the locking flap 33 in flush relationship. An arcuate camming surface 33*d* on the underside of the free end of locking flap 33 lies in snug engagement with a cam surface 31*m* provided on the base portion 31*d* of the body 31 immediately adjacent the recess 31*n*.

The recess 31*n* is of annular segmental configuration and thus defines an annular wall segment 31*p* which is depressable when the closure body portion 31 is laterally compressed between the thumb and forefinger. The inward depression of the wall segment 31*p* effects an upward camming of the locking flap 33 by virtue of the top end of the depressable wall segment 31*p* riding against an inclined surface 33*e* provided on the end of locking flap 33. Thus the extreme free edge of locking flap 33 is removed from its position of flush engagement with the base portion 31*d* to a slightly upwardly projecting position, where it can be engaged by the fingernail of the person opening the closure.

To facilitate the lifting of the free edge of the locking flap 33, a folding groove 33*f* may be formed in the underside of the locking flap 33 at a position inwardly of the lateral locking projections 33*c*. This permits the end portion of locking flap 33 to be folded upwardly by the finger to a substantially vertical position and sufficient force may then be applied to the locking flap 33 by the thumb and a finger to strip the locking projections 33*c* out of engagement with the undercut recesses 31*k* provided in the body portion 31 of the safety closure 30.

Referring particularly to FIG. 7, it has been found desirable to mold the free end portion of the locking flap 33 in a slightly downwardly inclined position relative to the remainder of the locking flap, thereby assuring that this end portion of the locking flap that lies outwardly of the folding groove 35*f* will be positioned in its locking position as shown in FIG. 6 and retained therein by the engagement of the projections 33*c* and corresponding undercut recess 31*k*.

Projection 31*q* on wall segment 31*p* opposite the free end of locking flap 33 guards against inadvertent opening by biting.

Figure 9:
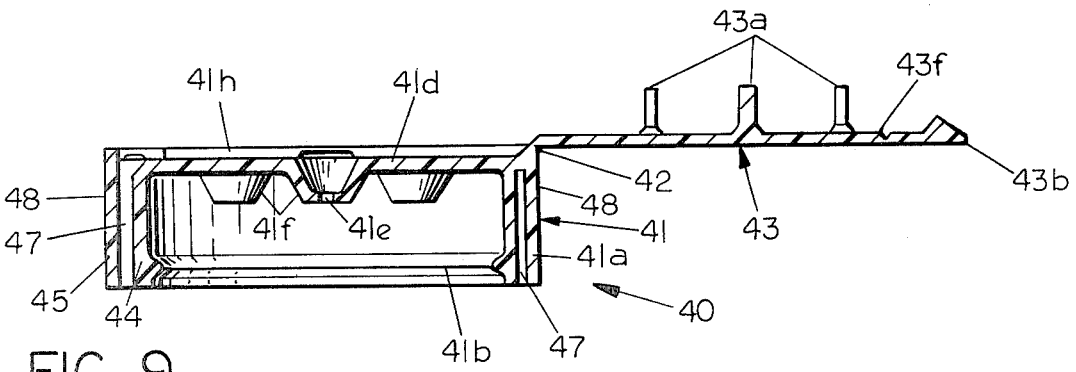
FIG. 9 is a vertical sectional view of a safety closure embodying this invention showing a modification in which a plurality of dispensing openings are provided in the closure.
Figure 10:
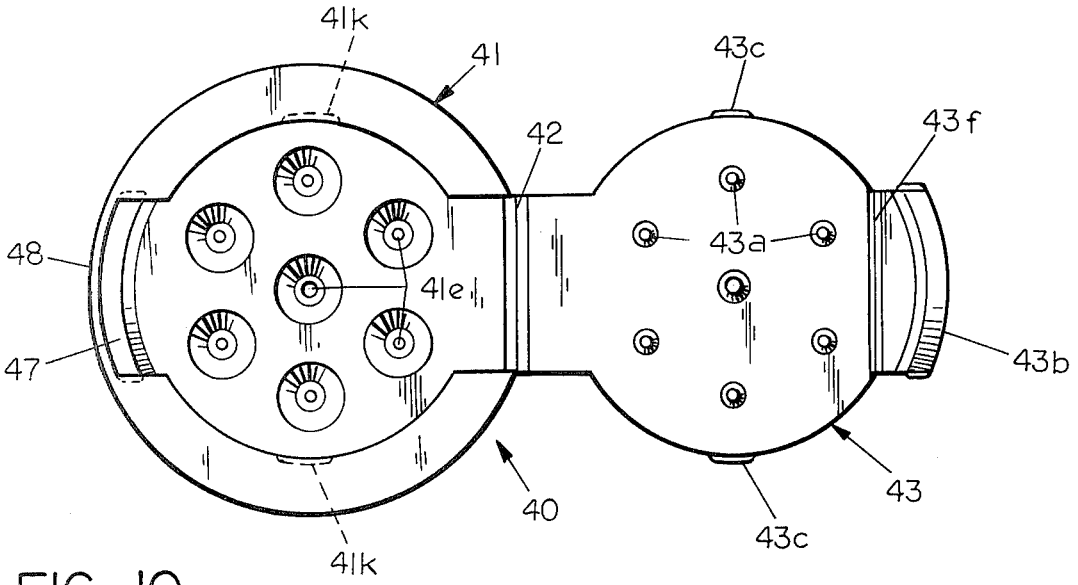
FIG. 10 is a top plan view of FIG. 9.
Figure 11:
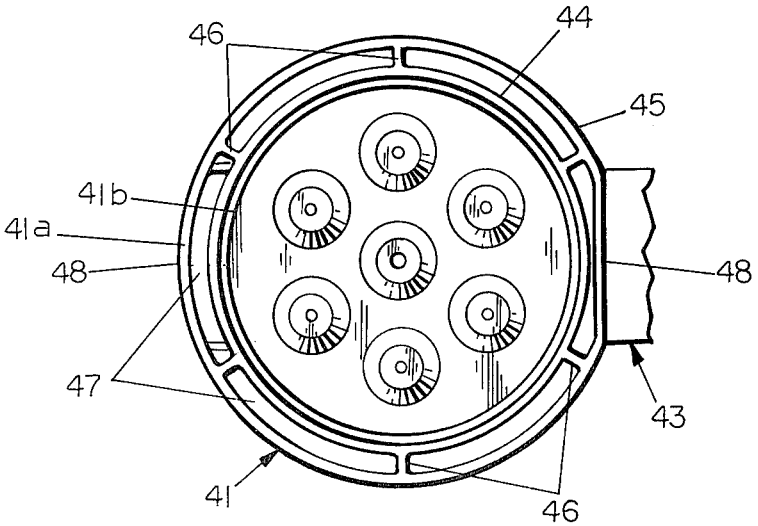
FIG. 11 is a bottom plan view of FIG. 9.

FIGS. 9, 10 and 11 illustrate still another modification of this invention wherein the specific safety closure 40 is provided with a plurality of dispensing apertures 40*e* such as would be required for the dispensing of granulated materials.

The closure 40 again comprises an inverted cup-shaped body portion 41 having an annular sidewall 41*a* which defines an internally projecting shoulder 41*b* suitable for snap engagement with a correspondingly shaped groove provided in a container neck (not shown). The locking flap 43 is integrally connected to the top corner of the body portion 41 by an integral hinge 42. The base portion 41*d* of closure 40 is provided with a plurality of dispensing openings 41*e* spaced in a generally circular pattern about an axially central opening 41*e*, and each opening is defined by a depending cone-shaped tubular member 41*f*. Base portion 41*d* of closure 40 is also provided with a depression 41*h* shaped to snugly conform to the configuration of the locking flap 43 so that when flap 43 is folded about hinge 42 to its closed position, all of the edges of the locking flap 43 are disposed in flush relationship with the top surface of base portion 41*d*. A plurality of integral sealing protuberances 43*a* are provided on the locking flap 43 to respectively engage the dispensing openings 41*e* when the flap 43 is folded to its closed position.

As best shown in FIG. 11, the annular sidewall 41*a* of body portion 41 is defined by two concentric annular portions 44 and 45 which are interconnected by a plurality of integral radial ribs 46. Thus a plurality of annular segment-shaped recesses 47 are formed around the periphery of the closure body portion 41 and one of such recesses and its deformable wall 48 lies directly under the free end of locking flap 43 when it is in its folded locked position and another of such recesses lies underneath the integral hinge 42.

Locking flap 43 is secured in its locked position by means similar to those described in the previous modifications. Lateral projections 43*c* provided on each side of the locking flap 43 engage undercut recesses 41*k* provided in the vertical walls of the depression 41*h* formed in the top surface of the body portion 41. If desired, a second folding groove 43*f* is provided near the outer end of the locking flap 43 to permit the free end of such locking flap to freely spring upwardly when released from locking engagement with the outer wall 45 of the closure body portion 41.

The operation of this modification of the invention is quite similar to the previous modifications. The application of a compression force to the deformable wall segments 48 lying under both ends of the locking flap 43 effects an upward camming of the free end of such locking flap 43 to a position where it can be readily engaged by the fingers. It will be noted that the deformation of the outer wall segment 48 at the position underneath the hinge 42 produces an upward turning movement on the locking flap 43 assisting in the release of the locking flap from its locked engagement with the closure body portion 41.

Figure 12:
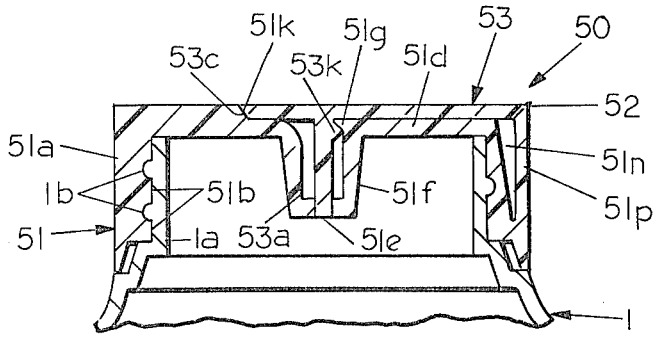
FIG. 12 is a vertical sectional view of a modified safety closure embodying this invention assembled to a container neck and with the locking flap disposed in its locked position.
Figure 13:
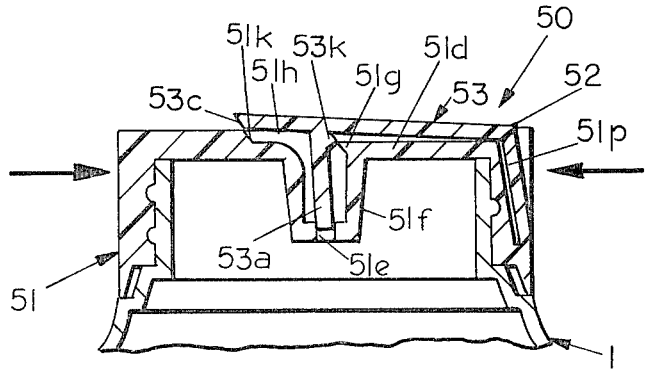
FIG. 13 is a view similar to FIG. 12 but illustrating the first manipulative step in the opening of the closure.
Figure 14:
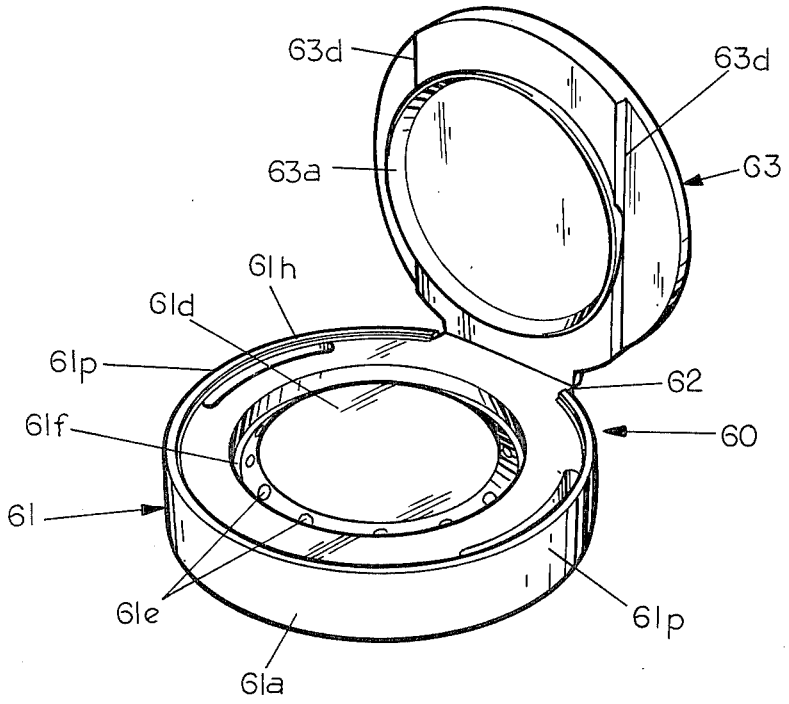
FIG. 14 is a perspective view of a safety closure embodying still another modification of this invention.
Figure 16:
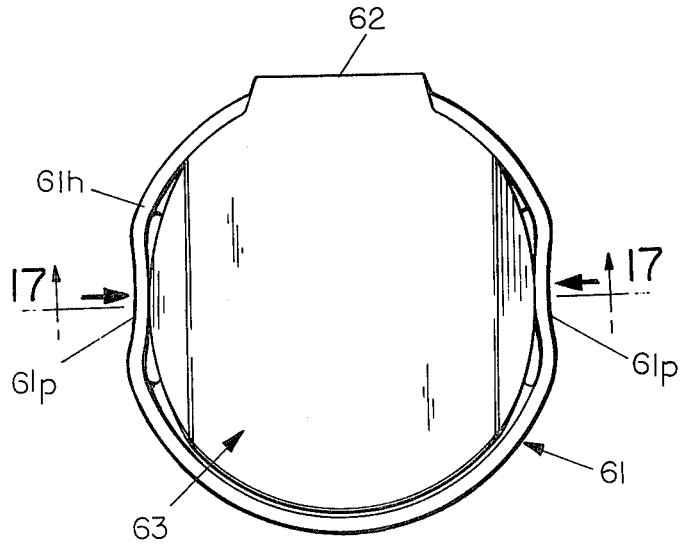
FIG. 16 is a top plan view of the safety closure of FIG. 14 but illustrating the position of the locking flap of the closure after the application of a lateral opening force to the sidewalls of the closure.
Figure 15:
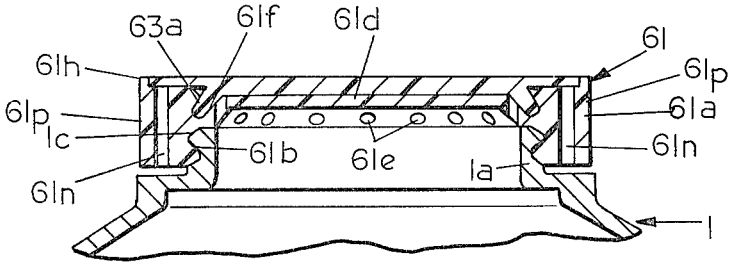
FIG. 15 is a vertical sectional view of the safety closure of FIG. 14, shown in assembled relationship to a container neck with the locking flap disposed in its locked position.
Figure 17:
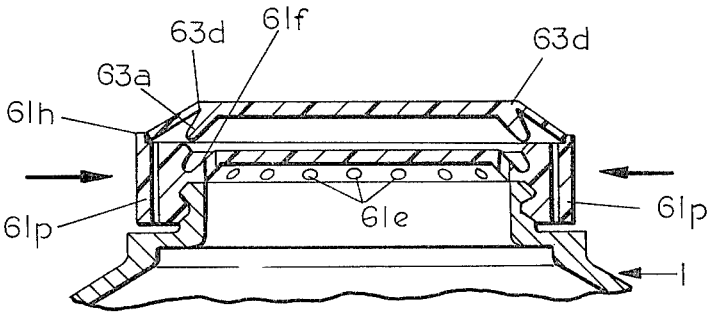
FIG. 17 is a vertical sectional view taken on the plane 17—17 of FIG. 16.

FIGS. 12 and 13 show still another modification of this invention in the form of a safety closure 50 wherein the inwardly deformable sidewall of the closure lies directly beneath the hinge portion of the locking flap and effects the initial upward movement of the free end of the locking flap to permit it to be pried open by the fingers.

In this modification, the closure 50 comprises an inverted cup-shaped body member 51 having an annular wall portion 51*a* defining internal threads 51*b* for cooperation with the threads 1*b* provided on the neck 1*a* of a container 1. The base portion 51*d* of the inverted cup-shaped body portion 51 defines a dispensing opening 51*e* at the end of a depending tubular protuberance 51*f*. Base portion 51*d* also defines a depression 51*h* which conforms to the configuration of a locking flap 53 which is integrally connected to the closure body portion 51 by an integral hinge 52. Locking flap 53 is substantially shorter than the diameter of body portion 51. Locking flap 53 is provided with a generally cylindrical protuberance 53*a* which enters the tubular element 51*f* to seal the dispensing opening 51*e*. Additionally, a projecting shoulder 53*k* provided on the sealing projection 53*a* engages an inwardly projecting shoulder 51*g* formed at the top end of the tubular portion 51*f*. Locking flap 53 is thus locked in its folded position wherein all of the edges of the locking flap are flush with the adjacent surface of the base portion 51*d* of the closure 50.

An annular segmental recess 51*n* is provided in the annular wall 51*a* of the body portion 51 immediately beneath the hinge portion 52. The recess 51*n* thus defines an inwardly deformable wall segment 51*p* which may be deformed inwardly by the application of pressure between the thumb and forefinger. Such inward deformation of the wall segment 51*p* moves the hinge 52 inwardly and effects the disengagement of the locking projection 53*k* on the locking flap 53 from the cooperating projection 51*g* provided on the body portion 51. At the same time, the inclined surface 53*c* on the free end portion of the locking flap 53 rides up a similarly inclined surface 51*k* on base portion 51*d* to assume the position shown in FIG. 13 wherein the free end portion of the locking flap 53 may be readily engaged by a fingernail and lifted to an open position.

Lastly, FIGS. 14 through 17 disclose a modified safety closure 60 embodying this invention wherein the entire locking flap 63 is of generally circular configuration conforming to the periphery of the closure body portion 61.

Closure 60 comprises an inverted cup-shaped body portion 61 having an annular wall 61*a* provided with an internal groove 61*b* which is designed to snap over a projecting bead 1*c* provided on the neck portion 1*a* of a container 1. The base portion 61*d* of safety closure 60 is provided with an upstanding, thin, annular wall portion 61*h* which defines a circular recess to snugly receive the integrally molded locking flap 63 therein when such flap is folded about its integral hinge 62 to its closed position illustrated in FIG. 15.

The base portion 61*d* is further provided with a depressed groove 61*f* within which a plurality of circumferentially spaced dispensing openings 16*e* are formed. The locking flap 63 is provided with an integral annular flange 63*a* which snugly engages the groove 61*f* to effect a sealing of the dispensing openings 61*e* in the closed, folded position of the locking flap 63. The groove 61*f* is slightly inclined to the vertical, as is the cooperating annular sealing flange 63*a*, hence the sealing flange 63*a* and the groove 61*f* additionallu function as the locking elements securing the locking flap 63 in its closed folded position. In such position, all of the peripheral edges of the locking flap 63 are flush with the top of the upstanding annular wall portion 61*h*.

In contrast to the modifications heretofore discussed, a pair of annular segment apertures 61*n* are respectively provided in diametrically opposed relationship in the annular wall portion 61*a* of the closure 60 but such apertures do not lie under either the free end of the locking flap 63 or the hinge end. Instead, they are disposed in general parallelism with the integral hinge 62 and thus underlie only the lateral peripheral edges of the locking flap 63. The apertures 61*n* inherently provide opposed wall segments 61*p* which are respectively inwardly deformable by the compression action of the thumb and forefinger. Such compressing action applied to the deformable wall sections 61*p* effect an upward bowing action on the locking flap 63 causing it to move out of its locked position and to assume the position illustrated in FIGS. 15 and 16. If desired, a pair of spaced grooves 63*d* may be formed in the locking flap 63 running generally perpendicular to the folding axis of such flap and assisting in the upward bowing of the locking flap 63 produced by the application of a compressive force to the inwardly deformable wall segments 61*p*. As is the case in the prior modifications, the opening movement of the locking flap 63 is completed by inserting the fingernail under the edge of such flap and elevating it to the position shown in FIG. 14.

The number of modifications of this invention herein disclosed clearly illustrate that the principles of the invention may be applied in a number of different safety closure configurattions. Further modifications will be readily apparent to those skilled in the art and it is intended that the scope of the invention be determined solely by the appended claims.

What is claimed is:

1. A safety closure for a container neck comprising, in combination:

(1) a one piece structure molded from a resilient plastic having an inverted cup-shaped body portion and a locking flap portion connected by an integral hinge to a top corner portion of the inverted cup-shaped body:

(2) means on the annular walls of said body for securing same in sealing relationship to the container neck;

(3) said base portion of the inverted cup-shaped body having at least one aperture therethrough a defining a dispensing outlet for the container contents;

(4) said base portion having a depression in its top surface conforming to the shape of said locking flap;

(5) said locking flap being foldable about the integral hinge to lie in said depression, the edges of said flap being substantially flush with the adjacent top surface of the base of said inverted cup-shaped body;

(6) cooperating locking means on said flap and said base portion for holding said flap in said base depression;

(7) means on said locking flap for sealing said dispensing outlet in the folded position of the flap;

(8) said inverted cup-shaped body having a recess in a portion of its annular wall underlying an edge of said flap in its folded position thereby forming an inwardly depressable wall segment; and (9) cooperating camming surfaces on said locking flap and said wall segment operable by manual inward depression of said wall segment to elevate at least an edge portion of said flap sufficiently to permit manual lifting thereof to open said dispensing outlet.

2. The combination defined in claim 1 wherein said dispensing outlet comprises a circular array of apertures.

3. The combination defined in claim 1 wherein said dispensing outlet is defined by a tubular portion formed in said base of the inverted cup-shaped body, and said means on said locking flap for sealing said dispensing outlet comprises a depending protuberance sealingly engaging the interior wall of said tubular portion.

4. The combination defined in claim 1 wherein said recess in said annular wall extends upwardly through said base portion and underlies the free end of said locking flap.

5. The combination defined in claims 1, 2, 3 or 4 wherein the outer free end portion of said locking flap is connected by a second integral hinge to the remaining portion of the locking flap, whereby only said free end portion is elevated by inward manual depression of said wall segment.

6. The combination defined in claims 1, 2, 3 or 4 wherein said locking means comprises a lateral projection on at least one side of said locking flap, said locking flap receiving depression in the top surface of said cup-shaped body having a lateral undercut to receive said lateral projection in locking relationship.

7. The combination defined in claim 1 wherein said wall recess is disposed in underlying relation to said integral hinge.

8. The combination defined in claim 1 wherein two of said wall recesses are provided in the annular wall of said body in diametrically opposed relationship.

9. The combination defined in claim 3 wherein said locking means comprises locking shoulders respectively formed on the inner wall of said tubular portion and on said protuberance.

10. The combination defined in claim 1 wherein said locking flap is of circular configuration of slightly less diameter than said base portion.

11. The combination defined in claim 10 wherein two of said recesses are provided in the annular wall of said body in diametrically opposed relationship and respectively underlie edge portions of said circular locking flap that are intermediate the hinge and the free end of the locking flap.

12. The combination defined in claims 1, 2 or 11 wherein said locking flap has at least one folding groove to facilitate upward buckling of the locking flap by the force exerted by inward depression of said wall segment.

* * * * *